US005450966A

United States Patent [19]

Clark et al.

[11] Patent Number: 5,450,966

[45] Date of Patent: Sep. 19, 1995

[54] MULTI-STAGE DISC SCREEN FOR CLASSIFYING MATERIAL BY SIZE

[75] Inventors: Brian K. Clark; Roy R. Miller, both of Eugene, Oreg.

[73] Assignee: Bulk Handling Systems, Inc., Eugene, Oreg.

[21] Appl. No.: 263,524

[22] Filed: Jun. 22, 1994

Related U.S. Application Data

[63] Continuation-in-part of Ser. No. 112,411, Aug. 26, 1993, abandoned.

[51] Int. Cl.[6] ..... B07B 13/05

[52] U.S. Cl. ..... 209/672; 209/668

[58] Field of Search ..... 209/667, 668, 671–674

[56] References Cited

U.S. PATENT DOCUMENTS

| | | | |
|---|---|---|---|
| 513,089 | 1/1894 | Crockett | 209/672 X |
| 530,262 | 12/1894 | Distl et al. | 209/667 |
| 785,508 | 3/1905 | Mason | 209/672 X |
| 1,941,147 | 12/1933 | Johlige | 209/672 X |
| 2,370,539 | 2/1945 | Hodecker | 209/668 |
| 2,417,921 | 3/1947 | Fox | 209/667 |
| 2,588,309 | 3/1952 | Troyer | 209/667 |
| 2,743,813 | 5/1956 | Erickson | 209/672 X |
| 3,367,494 | 2/1968 | Peterson | 209/668 |
| 4,301,903 | 11/1981 | Smith | 209/671 |
| 4,539,734 | 9/1985 | Gill | 209/668 |
| 4,653,648 | 3/1987 | Bielagus | 209/672 |
| 4,795,036 | 1/1989 | Williams | 209/667 |
| 4,858,180 | 8/1989 | Eriksson | 209/664 |
| 4,901,864 | 2/1990 | Dougherty | 209/672 |
| 5,051,172 | 9/1991 | Gilmore | 209/672 |
| 5,060,806 | 10/1991 | Savage | 209/668 |
| 5,163,564 | 11/1992 | Matula | 209/667 X |

FOREIGN PATENT DOCUMENTS

| | | | |
|---|---|---|---|
| 592126 | 1/1934 | Germany | 209/672 |
| 609919 | 2/1935 | Germany | 209/672 |

OTHER PUBLICATIONS

Bulk Handing Systems Product Brochure, *BHS Disc-Screens*, two pages.

*Primary Examiner*—William E. Terrell
*Assistant Examiner*—Boris Milef
*Attorney, Agent, or Firm*—Marger, Johnson, McCollom & Stolowitz

[57] ABSTRACT

A disc screen for classifying material by size. The disc screen comprises a frame, a plurality of shafts mounted on the frame parallel with one another, a first stage including discs mounted on the shafts in a substantially coplanar row, each of the discs having a perimeter shaped to maintain the space between discs substantially constant during rotation; and a second stage including discs mounted on the shafts in a substantially coplanar row, each of the discs having a perimeter shaped to maintain the space between discs substantially constant during rotation. The first stage discs are positioned to allow passage of only small fraction material and the second stage discs are positioned to allow passage of intermediate fraction material thereby classifying the material into a small fraction, an intermediate fraction and a large fraction.

18 Claims, 5 Drawing Sheets

MULTI-STAGE DISC SCREEN FOR CLASSIFYING MATERIAL BY SIZE

This is a continuation in part of application Ser. No. 08/112,411, filed Aug. 26, 1993, abandoned.

This invention was disclosed in the United States Patent and Trademark Office as evidenced by Disclosure Document No. 326,571, date stamped Mar. 5, 1993.

BACKGROUND OF THE INVENTION

1. Field of the Invention

This invention relates to an apparatus for classifying an admixture of materials by size. In particular, this invention relates to improvements in a disc screen that improves the screen's performance and reduces maintenance thereof.

2. Description of the Related Art

Disc or roll screens, as contemplated by the present invention are frequently used as part of a multi-stage materials separating system. Disc screens are used in the materials handling industry for screening large flows of materials to remove certain items of desired dimensions. In particular, disc screens are particularly suitable for classifying what is normally considered debris or residual materials. This debris may consist of various constituents. It may contain soil, aggregate, asphalt, concrete, wood, biomass, ferrous and nonferrous metal, plastic, ceramic, paper, cardboard, or other products or materials recognized as debris throughout consumer, commercial and industrial markets. The function of the disc screen is to separate the materials fed into it by size. The size classification may be adjusted to meet virtually any specific application.

Disc screens generally have a screening bed having a series of rotating spaced parallel shafts each of which has a longitudinal series of concentric screen discs separated by spacers which interdigitate with the screen discs of the adjacent shafts. The relationship of the discs and spacers on one shaft to the discs and spacers on each adjacent shaft form an opening generally known in the industry as the interfacial opening or "IFO". The IFOs permit only material of acceptable size to pass downwardly through the rotating disc bed. The acceptable sized material which drops through the IFO is commonly referred to in the industry as Accepts or Unders.

The discs are all driven to rotate in a common direction from the infeed end of the screen bed to the outfeed or discharge end of the bed. Thus, materials which are larger than the IFO, referred to in the industry as Overs, will be advanced on the bed to the outfeed end of the bed and rejected.

A major problem with such disc screens is jamming. Where the discs are not in line, material tends to jam between the disc and the adjacent shaft, and physically forcing the screen to stop. This phenomenon can be deleterious to the conventional disc screen. Although the jamming phenomenon may not cause the roll screen to stop completely, it may cause momentary stoppages. Such stoppages may not cause the drive mechanism of the roll screen to turn off but they may cause substantial mechanical shock. This mechanical shock will eventually result in the premature failure of the roll screen's roll assemblies and drive mechanism.

Accordingly, an important object of the present invention is to provide a new and useful apparatus for classifying material by size which avoids the problem of jamming.

Another object of the invention is to provide a new and useful method of classifying material by size which avoids the problem of jamming.

SUMMARY OF THE INVENTION

The invention concerns an apparatus for classifying material by size. It comprises a frame, a plurality of shafts mounted on the frame substantially parallel with one another and defining a substantially planar array, means for rotating the shafts in ganged relation to one another, and a plurality of discs mounted on the shafts in a substantially coplanar row, each of the discs having a perimeter shaped to maintain the space between discs substantially constant during rotation.

In accordance with this invention, we disclose a method for classifying material by size. This method comprises defining a plurality of substantially uniform openings disposed between a plurality of shafts arranged to define a substantially planar array, mounting noncircular discs on the shafts in substantially parallel rows, rotating the shafts in the same direction; dropping the material on the shafts at one side of the array so that shaft rotation causes the material to be pushed by the discs across the remainder of the shafts in the array, and maintaining the spacing between discs in a row substantially uniform during rotation.

In an alternative embodiment of the invention, we disclose an apparatus for classifying material by size which includes a frame; a plurality of shafts mounted on the frame substantially parallel with one another; a first stage including discs mounted on the shafts in a substantially coplanar row, each of the discs having a perimeter shaped to maintain the space between discs substantially constant during rotation; and a second stage including discs mounted on the shafts in a substantially coplanar row, each of the discs having a perimeter shaped to maintain the space between discs substantially constant during rotation. The first stage discs are positioned to allow passage of only small fraction material and the second stage discs are positioned to allow passage of intermediate fraction material and thereby classifying the material into a small fraction, an intermediate fraction and a large fraction.

DETAILED DESCRIPTION OF THE INVENTION

Figure 1:
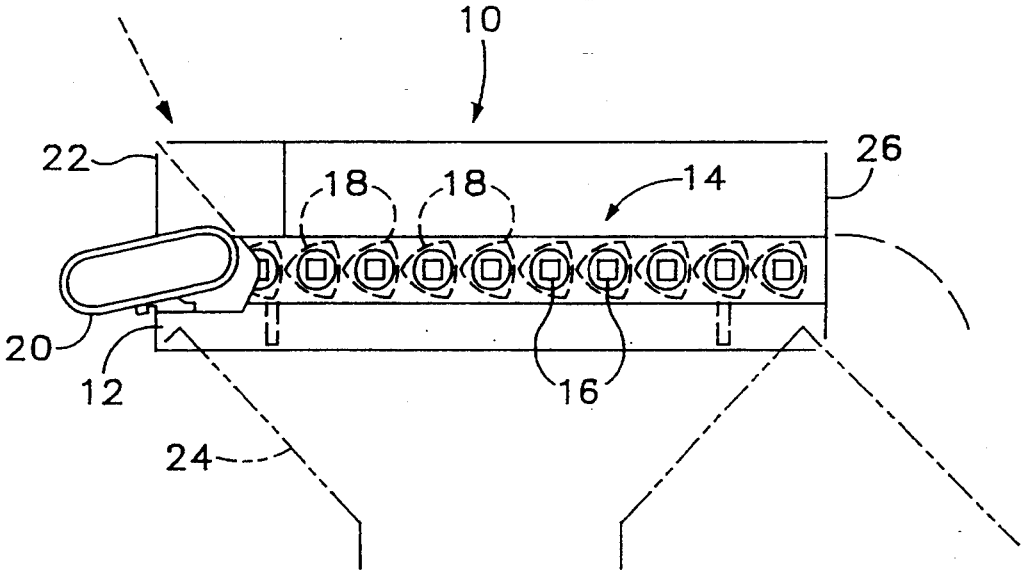
FIG. 1 is a side elevational schematic illustration of a disc screen apparatus embodying the invention.

Referring to FIG. 1, a disc screen apparatus 10 comprising a frame 12 supporting a screening bed 14 having a series of corotating spaced parallel shafts 16 of rectangular perimeter and similar length and each of which has a longitudinal series of screen discs 18. The shafts 16 are driven clockwise in unison in the same direction by suitable drive means 20. Material such as debris to be screened is delivered to the infeed end 22 of the screen bed 14 by means of a chute (not shown) as indicated by directional arrows. The constituents of acceptable size (Accepts) drop through the IFOs defined by the discs 18 and are received in a hopper 24. Debris constituents which are too large to pass through the IFOs (Overs) are advanced to and discharged, as indicated by directional arrows, from the rejects end 26 of the screening bed 14.

Figure 2:
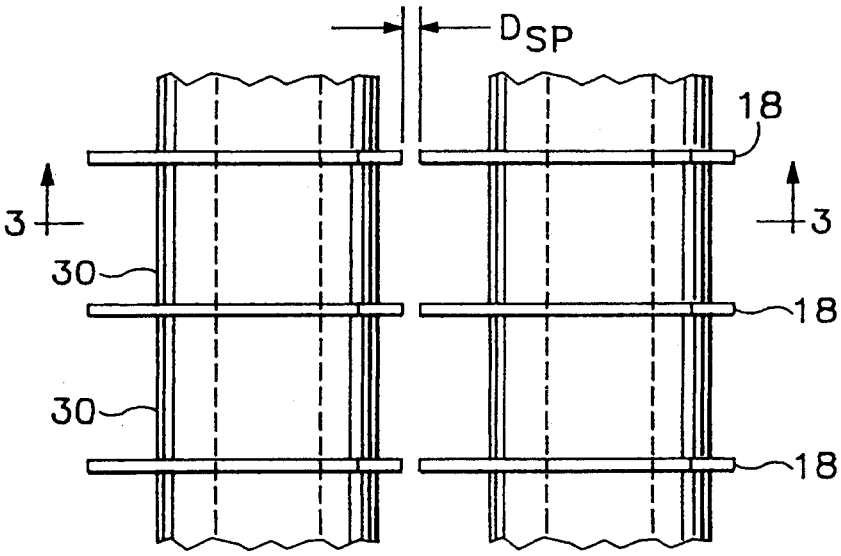
FIG. 2 is an enlarged fragmental top plan view of the screening bed of the apparatus.
Figure 3:
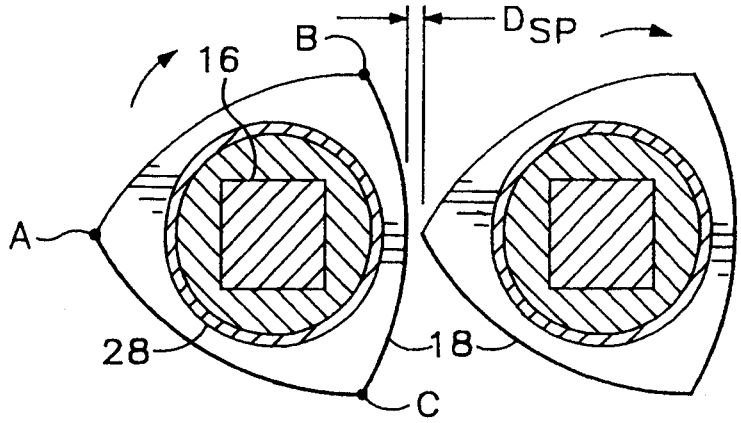
FIG. 3 is a fragmentary vertical sectional detail view taken substantially along the line 3—3 of FIG. 2.
Figure 3A:
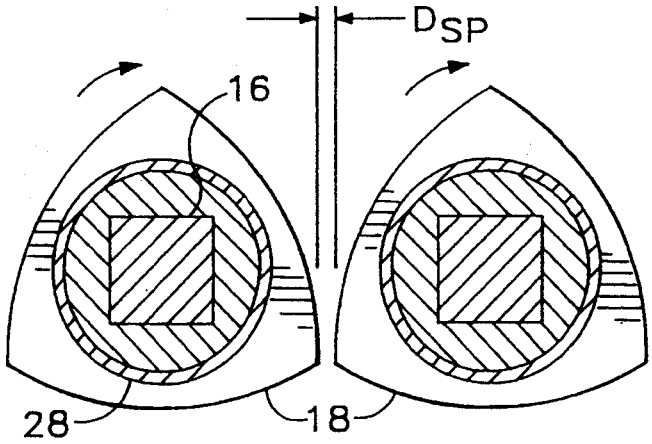
FIG. 3*a* is a sectional detail view, as depicted in FIG. 3, where the adjacent discs are rotated 90 degrees about their respective horizontal axes.
Figure 3B:
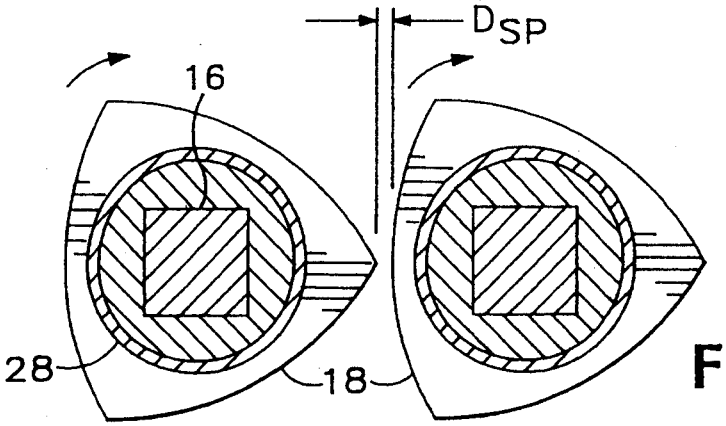
FIG. 3*b* is a sectional detail view, as depicted in FIG. 3, where the adjacent discs are rotated 180 degrees about their respective horizontal axes.
Figure 3C:
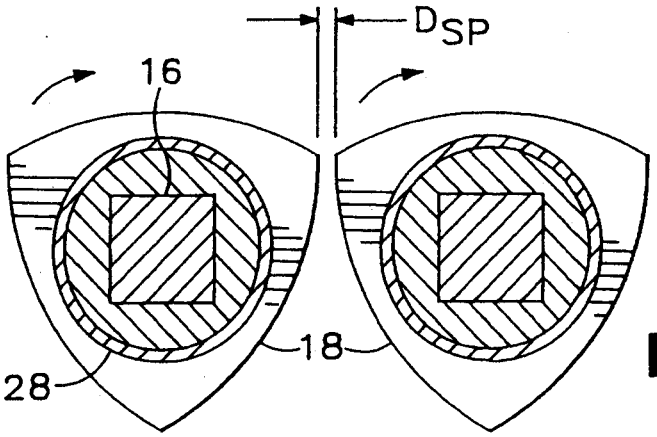
FIG. 3*c* is a sectional detail view, as depicted in FIG. 3, where the adjacent discs are rotated 270 degrees about their respective horizontal axes.

As best seen in FIG. 2, there exists a constant space $D_{sp}$ between discs of adjacent shafts. As best seen in FIG. 3 through FIG. 3*c*, the discs 18 have perimeters shaped so that space $D_{sp}$ remains constant during rotation. Preferably the perimeter of discs 18 is defined by three sides having substantially the same degree of curvature. Most preferably, the perimeter of discs 18 is defined by drawing an equilateral triangle which has vertices A, B, and C. And thereafter drawing three arcs: (1) between vertices B and C using vertex A as the center point of the arc; (2) between vertices C and A using vertex B as the center point for the arc; and (3) between vertices A and B using vertex C as the center point of the arc.

This uniquely shaped disc perimeter provides several advantages. First, although space $D_{sp}$ changes location during the rotation of discs 18 as shown in FIGS. 3–3*c*, the distance between the discs remains constant. In conventional disc screens which have toothed discs which interdigitate, the distance between a disc and its adjacent shaft varies, depending upon the position of the disc during its rotation. This interdigitation action tends to pinch materials between the disc and its adjacent shaft, resulting in frequent jamming.

Another advantage resulting from the uniquely shaped perimeter is that as the discs 18 rotate, they move the debris in an up and down fashion which creates a sifting effect and facilitates classification. This phenomenon produces a disc screen which is very efficient in classifying materials.

Figure 4:
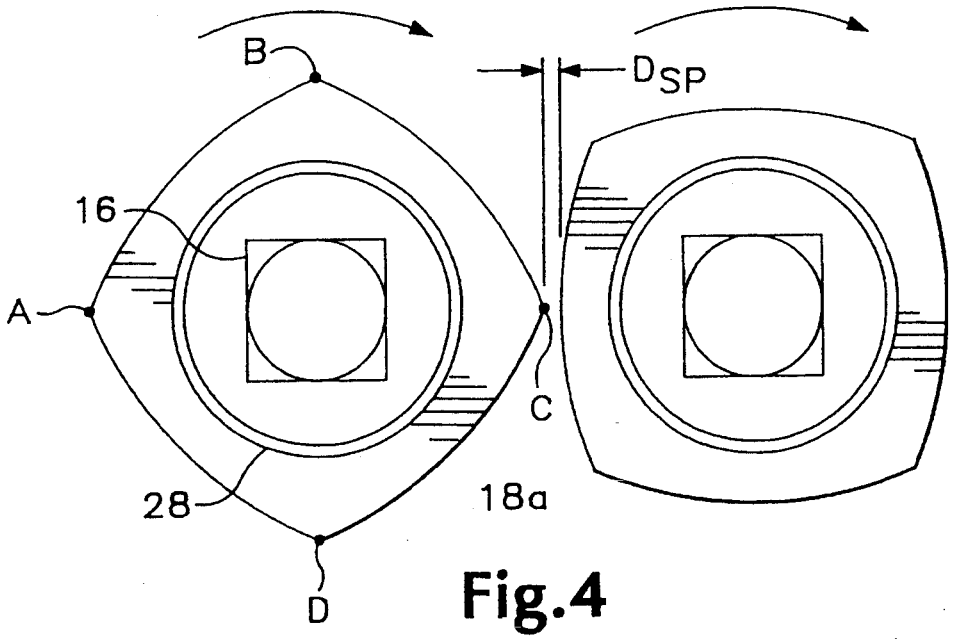
FIG. 4 is a sectional detail view of an alternative embodiment of the invention employing a four-sided disc.

Turning now to FIG. 4, an alternative embodiment of the present invention is shown. FIG. 4 illustrates a four-sided disc 18. Preferably the perimeter of the four-sided disc 18*a* is defined by having four sides having substantially the same degree of curvature. Most preferably, the perimeter of disc 18*a* is defined by (1) determining the desired center distance L between adjacent shafts and then determining the desired clearance or gap $D_{sp}$ between adjacent coplanar discs; (2) drawing a square having corners A, B, C, and D and side length S. The side length S is calculated as follows:

$$S=(L-D_{sp})^* \text{ COS } 45/\text{COS } 22.5.$$

Arcs are then drawn between corners A and B, B and C, C and D, and D and A. The radii R of the arcs is the difference between distance L and gap $D_{sp}$ ($R=L-D_{sp}$).

Figure 5:
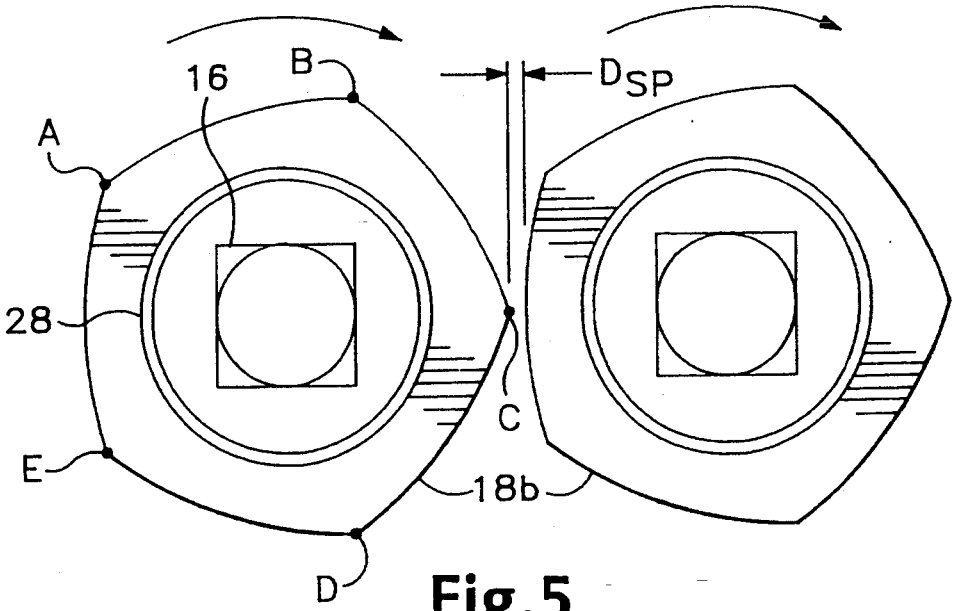
FIG. 5 is a sectional detail view of an alternative embodiment of the invention employing a five-sided disc.

Alternatively, the present invention can employ a five-sided disc 18*b* as illustrated in FIG. 5. Preferably the perimeter of the five-sided disc 18*b* is defined by having five sides having substantially the same degree of curvature. Most preferably, the perimeter of disc 18*b* is defined by drawing a regular pentagon having vertices A, B, C, D, and E. And thereafter drawing five arcs: (1) between vertices A and B using vertex D as the center point of the arc; (2) between vertices B and C using vertex E as the center point of the arc; (3) between vertices C and D using vertex A as the center point of the arc; (4) between vertices D and E using vertex B as the center point of the arc; and (5) between vertices E and A using vertex C as the center point of the arc.

Discs 18*a* and 18*b* are very beneficial in classifying materials which are more fragile or delicate. As the number of sides of the discs are increased, from 3 to 4 or 5 for example, the amplitude of rotation decreases. This effect is quite dramatic when employing larger diameter discs. Higher amplitudes of the sifting action are more likely to damage delicate or fragile materials. On the other hand, fewer sides increases the amplitude and enhances the sifting action of the screen.

For optimum results, care must be exercised to assure that the IFO spacing between the discs 18 be as accurate as practicable. To attain such accuracy, generally flat discs 18 are desirably mounted on the shafts 16 in a substantially coplanar row in substantially parallel relation and radiating outwardly from each of the shafts 16 at right angles to the longitudinal axes of the shafts 16.

Preferably, the discs 18 can be held in place by spacers 30. For this purpose, the spacers 30 comprise central apertures to receive the hubs 28 therethrough. The spacers 30 are of substantially uniform size and are placed between the discs 18 to achieve substantially uniform IFOs.

The use of spacers 30 has numerous advantages. First, the size of the IFOs can be easily adjusted by employing spacers 30 of various lengths and widths corresponding to the desired sized opening without replacing the shafts or having to manufacture new discs. The distance between adjacent discs 18 can be changed by employing spacers 30 of different lengths. Similarly, the distance between adjacent shafts can be changed by employing spacers 30 of different radial widths. Preferably, the shafts 16 can be adjusted to also vary the size of the IFOs. Thus, in this embodiment, manufacturing costs are greatly reduced as compared to mounting of the discs directly on the shaft. Moreover, damaged discs can be easily replaced.

Alternatively, the discs 18 are mounted by sets concentrically and in axially extending relation on hubs 28 complementary to and adapted for slidable concentric engagement with the perimeter of the shafts 16. For this purpose, the discs 18 comprise central apertures to receive the hubs 28 therethrough. The discs 18 are attached in substantially accurately spaced relation to one another axially along the hubs 28 in any suitable manner, as for example by welding.

Depending on the character and size of the debris to be classified, the discs 18 may range from about 6 inches major diameter to about 16 inches major diameter. Again, depending on the size, character and quantity of the debris, the number of discs per shaft range from about 5 to about 60.

Figure 6:
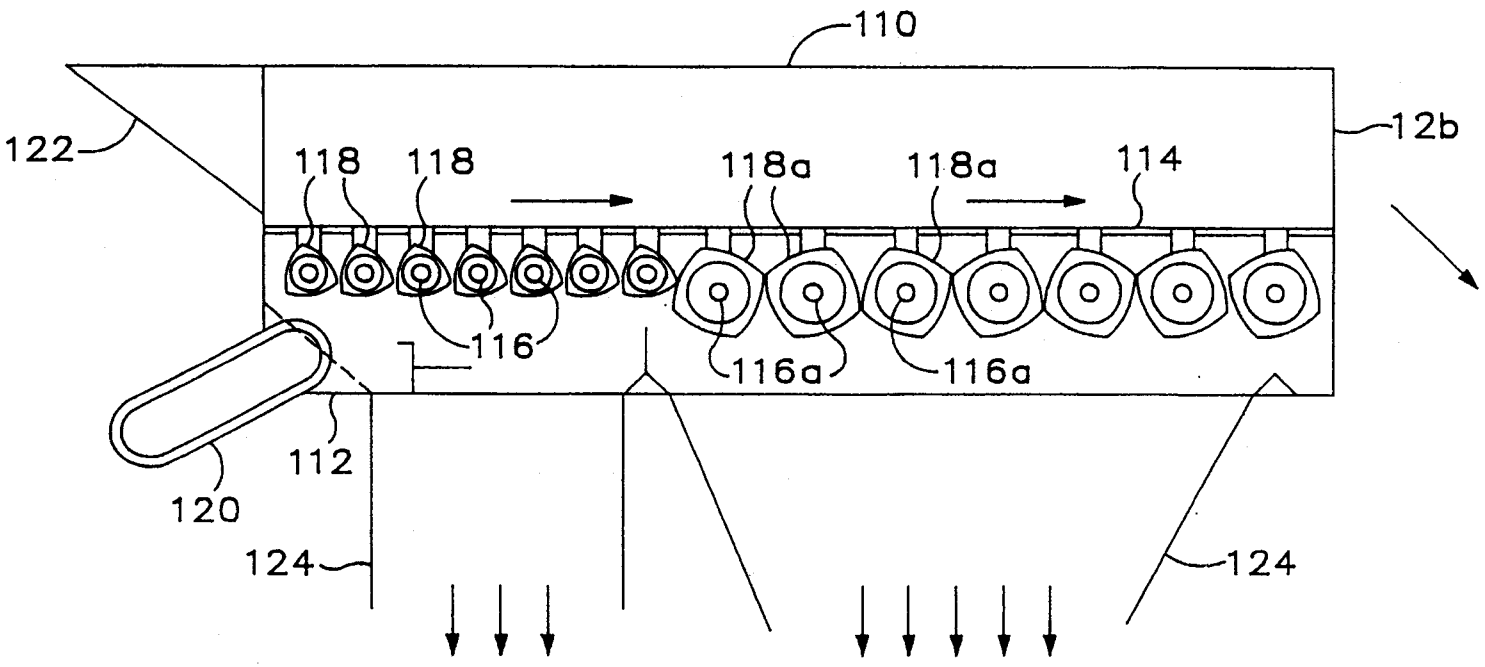
FIG. 6 is a side elevational schematic illustration of an alternative embodiment of the invention.

Referring to FIG. 6, an alternative embodiment of the invention is illustrated. A disc screen 110, comprising a frame 112 supporting a screening bed 114 having a first stage of corotating spaced parallel shafts 116 of similar length and each of which has a longitudinal series of screen discs 118 and having a second stage of corotating spaced parallel shafts 116a of similar length and each of which has a longitudinal series of screen discs 118a. The shafts 116 and 116a are driven clockwise as hereafter described in the same direction by suitable drive means 120. Material such as debris to be screened is delivered to the infeed end 122 of the screen bed 114 by means of a chute (not shown) as indicated by directional arrows. In the first stage of the apparatus 110, only constituents of the smallest fraction of debris drop through the IFO's defined by the discs 118 and are received in a hopper 124 as indicated by directional arrows. Debris constituents which are too large to pass through the IFOs defined by discs 118 are advanced to the second stage of the apparatus 110. In the second stage, constituents of intermediate fraction of debris drop through the IFOs defined by the discs 118a and are received in a hopper 124a as indicated by directional arrows. Debris constituents which are too large to pass through the IFOS's defined by discs 118a are advanced to and discharged, as indicated by directional arrows, from the rejects end 126 of the screening bed 114. Screening debris by way of this embodiment of the invention results in classifying the debris into three fractions: small, intermediate, and large.

In general the small fraction material comprises particles having a diameter of less than about 4 inches and the intermediate fraction material comprises particles having a diameter of less than about 8 inches. Preferably the small faction material particles have a diameter of less than 3 inches and the intermediate fraction material particles have a diameter of less than 6 inches. Most preferably, the small fraction particles have diameters of less than 2 inches and the intermediate fraction particles have diameters of less than 4 inches.

In general, debris traveling horizontally through the first stage travels at a velocity ranging from about 50 to 200 feet per minute (FPM) and the debris traveling horizontally through the second stage at a velocity from about 50 to 250 FPM. Preferably the first stage debris travels at a velocity of about 75 to 150 FPM, most preferably from about 120 FPM; and the second stage debris travels at a velocity ranging from about 100 to 200 FPM, most preferably from about 146 FPM.

Although many combinations of first stage and second stage velocities may be chosen, it is desirable that the first stage and second stage discs rotate in cooperation with one another. To maintain a constant gap between the last row of the first stage discs and the first row of second stage discs, the discs must rotate so that the peak or points of the first stage disc correspond to the sides or valleys of the second stage discs. This relationship is maintained by the following formula:

$$(RPM)_1=(S_2/S_1)\,(RPM)_2$$

where $(RPM)_1$ and $(RPM)_2$ are the revolutions per minute of the first stage discs and second stage discs, respectively, and $S_1$ and $S_2$ are the number of sides of the first stage discs and the second stage discs respectively. For example, for a two stage screen using 3 and 4 sided discs, $(RPM)_1=4/3(RPM)_2$. That is, the four-sided second stage discs are rotated at $\frac{3}{4}$ the rotation speed of the three-sided first stage disc to maintain proper spacing.

As with other previously discussed embodiments of the invention, discs 118 and 118a have perimeters shaped so that space $D_{sp}$ remains constant during rotation. Preferably the perimeter of discs 118 is defined by three sides having substantially the same degree of curvature and defined as shown in FIGS. 2–3c. Similarly, the perimeter of discs 118a is defined by four sides having substantially the same degree of curvature and defined as shown in FIG. 4.

Multi-stage disc screens have several advantages. First, additional stages allows the user to classify material into multiple factions of increasing size. In addition, multiple stage classifying using a screen results in more efficient separation. Because the velocity of the second stage is greater than the first stage discs, the material which is speeds up and tends to spread out when it passes from the first stage to the second stage of the bed. This in turn accelerates the separation process and results in more efficient screening.

Figure 7:
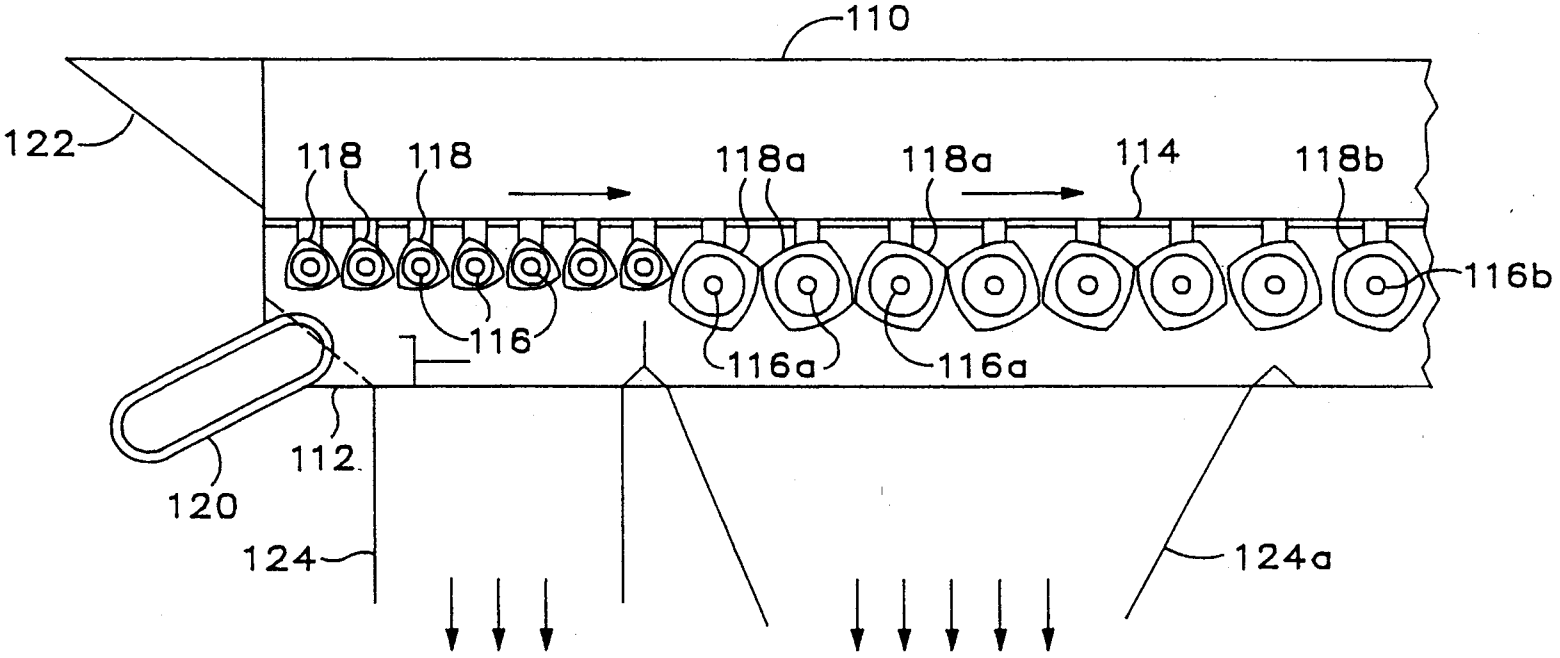
FIG. 7 is a side elevational schematic illustration of an alternative three-stage embodiment according to the present invention.

In alternative embodiments of the invention, additional stages may be added to the apparatus to provide further classifying of the debris to be screened. For example, a three stage screen could be employed where the first stage comprises three sided discs, the second stage comprises four-sided discs, and third stage comprises five-sided discs. Referring to FIG. 7, a three-stage embodiment of the present invention is shown. Disc screen 111 is very similar to disc screen 110 except that it comprises a third stage of five-sided discs 118b, mounted on parallel shafts 116b. In disc screen 111, $(RPM)_2=\frac{3}{4}(RPM)_1$, and $(RPM)_3=3/5(RPM)_1$. Classifying debris with this embodiment of the invention would produce four fractions of debris having graduated sized diameters.

It will be understood that variations and modifications may be effected without departing from the spirit and scope of the novel concepts of this invention.

We claim:

1. An apparatus for classifying material by size comprising:

a frame;

a plurality of shafts mounted on the frame substantially parallel with one another;

a first stage comprising discs, having $S_1$ sides, mounted on the shafts in a substantially coplanar row, each of the discs having a perimeter shaped to maintain the space between discs substantially constant during rotation; and a second stage comprising discs, having $S_2$ sides, mounted on the shafts in a substantially coplanar row, each of the discs having a perimeter shaped to maintain the space between discs substantially constant during rotation, wherein $S_1$ and $S_2$ are integers and $S_2>S_1$, and the first stage discs are positioned to allow passage of only small faction material and the second stage discs are positioned to allow passage of intermediate fraction material thereby classifying the material into three fractions of particles having diameters of increasing size.

2. The apparatus of claim 1 wherein the perimeter of the first stage discs is defined by the steps comprising:

(a) drawing a square, having four corners A, B, C, and D, the square having side length S defined as $S=(L-D_{sp})^* \cos 45/\cos 22.5$, wherein L is the distance between two adjacent shafts and $D_{sp}$ is the distance between two adjacent coplanar discs; and (b) drawing arcs between corner A and corner B, corner B and corner C, corner C and corner D, and corner D and corner A, each arc having a radius R defined as $$R=L-D_{sp}$$

wherein L and $D_{sp}$ are defined as in step (a) above.

3. The apparatus of claim 1 wherein the apparatus further includes a plurality of first stage discs rows spaced apart from one another in substantially parallel relation and a plurality of second stage discs rows spaced apart from one another in a substantially parallel relation.

4. The apparatus of claim 1 wherein the shafts are rectangularly-shaped.

5. The apparatus of claim 1 wherein the discs of the first and second stages are generally flat and radiate outwardly from each of the shafts at right angles to the longitudinal axis of the shafts.

6. The apparatus of claim 1 wherein a plurality of either the first stage discs or the second stage discs are provided on each of the shafts, and further comprising means for selectively moving the plurality of discs mounted on each of the shafts toward or away from one another.

7. The apparatus of claim 1 further comprising a third stage of discs mounted on the shafts in a substantially coplanar row, each of the discs having a perimeter shaped to maintain the space between discs substantially constant during rotation, wherein the third stage discs are positioned to allow passage of large fraction material.

8. The apparatus of claim 1 wherein the small fraction material comprises particles having a diameter of less than about 4 inches and the intermediate fraction material comprises particles having a diameter of less than about 8 inches.

9. The apparatus of claim 7 wherein the small fraction material comprises particles having a diameter of less than about 2 inches, intermediate fraction material comprises particles having a diameter of less than about 4 inches, and large fraction material comprises particles having a diameter of less than 6 inches.

10. A method for classifying material by size using an apparatus, as defined by claim 1, which comprises:

selectively moving the discs of one of the first and second stages to define a plurality of uniform openings disposed between the shafts;

rotating the shafts in the same direction;

dropping the material on the shafts at one side of the apparatus so that shaft rotation causes the material to be pushed by the discs across the remainder of the shafts in the apparatus; and maintaining the spacing between discs in a row substantially uniform during rotation.

11. An apparatus for classifying material by size comprising:

a frame;

a plurality of shafts mounted on the frame substantially parallel with one another;

a first stage of discs mounted on the shafts in a substantially coplanar row, each of the discs having a perimeter shaped to maintain the space between discs substantially constant during rotation and defined by three arcs having substantially the same degree of curvature wherein the first stage discs are positioned to allow passage of particles having a diameter of less than about 2 inches; and a second stage of discs mounted on the shafts in a substantially coplanar row, each of the discs having a perimeter shaped to maintain the space between discs substantially constant during rotation and defined by four arcs having substantially the same degree of curvature wherein the second stage discs are positioned to allow passage of particles having a diameter of less than about 4 inches.

12. The apparatus of claim 11 further comprising a third stage of discs mounted on the shafts in a substantially coplanar row, each of the discs having a perimeter shaped to maintain the space between discs substantially constant during rotation and defined by five arcs having a substantially the same degree of curvature wherein the third stage discs are positioned to allow passage of particles having a diameter of less than about 6 inches.

13. A method for classifying material by size comprising the steps of:

defining a first stage of substantially uniform openings disposed between a plurality of shafts arranged to define a substantially planar array, the first stage openings being sized to allow passage of small fraction material;

defining a second stage of substantially uniform openings disposed between a plurality of shafts arranged to define a substantially planar array, the second stage openings being sized to allow passage of intermediate fraction material;

mounting noncircular discs on the shafts in substantially parallel rows;

rotating the shafts in the same direction such that $(RPM)_1=(S_1/S_2)\ (RPM)_2$, wherein $(RPM)_1$ is the revolutions per minute of the first stage discs, $(RPM)_2$ is the revolutions per minute of the second stage discs, $S_1$ is the number of sides of the first stage discs, and $S_2$ is the number of sides of the second stage discs, wherein $S_2>S_1$;

dropping the material on the shafts at one side of the array so that shaft rotation causes the material to be pushed by the discs across the remainder of the shafts in the array; and maintaining the spacing between discs in a row substantially uniform during rotation.

14. An apparatus for classifying material by size comprising:

a frame;

a plurality of shafts mounted on the frame substantially parallel with one another;

a first stage comprising discs mounded on the shafts in a substantially coplanar row, each of the discs having a perimeter defined by three arcs having substantially the same degree of curvature; and a second stage comprising discs mounted on the shafts in a substantially coplanar row, each of the discs having a perimeter defined by four arcs having substantially the same degree of curvature, wherein the first stage discs are positioned to allow passage of only small fraction material and the second stage discs are positioned to allow passage of intermediate fraction material thereby classifying the material into three fractions of particles having diameters of increasing size.

15. The apparatus of claim 14 wherein the perimeter of the first stage discs is defined by the steps comprising:

drawing an equilateral triangle having vertices A, B, and C;

drawing an arc, having a center point located at vertex A, between end point B and vertex C; and drawing an arc, having a center point located at vertex B, between vertex C and vertex A.

16. The apparatus of claim 15 wherein the perimeter of the second stage discs is defined by the steps comprising:

(a) drawing a square, having four corners A, B, C, and D, the square having side length S defined as $$S=(L-D_{sp})^* \text{ COS } 45/\text{COS } 22.5,$$

wherein L is the distance between two adjacent shafts and $D_{sp}$ is the distance between two adjacent coplanar discs; and (b) drawing arcs between corner A and corner B, corner B and corner C, corner C and corner D, and corner D and corner A, each arc having a radius R defined as $$R=L-D_{sp}$$

wherein L and $D_{sp}$ are defined in step (a) above.

17. An apparatus for classifying material by size comprising:

a frame;

a plurality of shafts mounted on the frame substantially parallel with one another;

a first stage comprising discs mounded on the shafts in a substantially coplanar row, each of the discs having a perimeter defined by four arcs having substantially the same degree of curvature; and a second stage comprising discs mounted on the shafts in a substantially coplanar row, each of the discs having a perimeter defined by five arcs having substantially the same degree of curvature, wherein the first stage discs are positioned to allow passage of only small fraction material and the second stage discs are positioned to allow passage of intermediate fraction material thereby classifying the material into three fractions of particles having diameters of increasing size.

18. An apparatus for classifying material by size comprising:

a frame;

a plurality of shafts mounted on the frame substantially parallel with one another;

a first stage comprising discs mounted on the shafts in a substantially coplanar row, each of the discs having a perimeter defined by the steps comprising (a) drawing a square, having four corners A, B, C, and D, the square having side length S defined as $$S=(L-D_{sp})^* \text{ COS } 45/\text{COS } 22.5,$$

wherein L is the distance between two adjacent shafts and $D_{sp}$ is the distance between two adjacent coplanar discs, and (b) drawing arcs between corner A and corner B, corner B and corner C, corner C and corner D, and corner D and corner A, each arc having a radius R defined as $$R=L-D_{sp}$$

wherein L and $D_{sp}$ are defined as in step (a) above;

a second stage comprising discs mounted on the shafts in a substantially coplanar row, each of the discs having a perimeter defined by the steps comprising drawing a regular pentagon having vertices A, B, C, C, and E, drawing an arc, having a center point located at vertex D, between vertex A and vertex B, drawing an arc, having a center point located at vertex E, between vertex B and vertex C, drawing an arc, having a center point located at vertex A, between vertex C and vertex D, drawing an arc, having a center point located at vertex B, between vertex D and vertex E, and drawing an arc, having a center point located at vertex C, between vertex E and vertex A, wherein the first stage discs are positioned to allow passage of only small fraction material and the second stage discs are positioned to allow passage of intermediate fraction material thereby classifying the material into three fractions of particles having diameters of increasing size.

* * * * *